US007812788B2

(12) United States Patent
Jung et al.

(10) Patent No.: US 7,812,788 B2
(45) Date of Patent: Oct. 12, 2010

(54) PLASMA DISPLAY APPARATUS AND DRIVING METHOD OF THE SAME

(75) Inventors: Kyoung Jin Jung, Gumi-si (KR); Ki Duck Cho, Changwon-si (KR); Yoon Chang Choi, Milyang-si (KR); Min Soo Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 955 days.

(21) Appl. No.: 11/322,322

(22) Filed: Jan. 3, 2006

(65) Prior Publication Data

US 2007/0024530 A1 Feb. 1, 2007

(30) Foreign Application Priority Data

Jul. 28, 2005 (KR) ..... 10-2005-0069154

(51) Int. Cl.
*G09G 3/28* (2006.01)

(52) U.S. Cl. ..... 345/60; 345/67; 345/68; 345/208; 345/210; 315/169.4

(58) Field of Classification Search ..... 345/60–72, 345/41–42, 204–206, 690–694, 208–210; 315/169.1–169.4
See application file for complete search history.

(56) References Cited

U.S. PATENT DOCUMENTS 6,011,355 A * 1/2000 Nagai ..... 315/169.3
6,084,559 A * 7/2000 Nagao et al. ..... 345/67
6,337,673 B1 * 1/2002 Ide et al. ..... 345/60
6,414,656 B1 * 7/2002 Hong ..... 345/60
6,900,781 B1 * 5/2005 Mori et al. ..... 345/60
6,906,689 B2 * 6/2005 Lee et al. ..... 345/60
7,116,060 B2 * 10/2006 Lin et al. ..... 315/169.4
7,116,289 B2 * 10/2006 Yamada ..... 345/60
7,133,008 B2 * 11/2006 Naganuma ..... 345/63
7,173,580 B2 * 2/2007 Weitbruch et al. ..... 345/60
7,274,344 B2 * 9/2007 Lacoste et al. ..... 345/68
7,338,337 B2 * 3/2008 Yamauchi et al. ..... 445/6
7,355,565 B2 * 4/2008 Kim et al. ..... 345/60

(Continued)

FOREIGN PATENT DOCUMENTS

EP 1 376 524 A2 1/2004

(Continued)

OTHER PUBLICATIONS

European Search Report dated Jun. 14, 2006.

(Continued)

*Primary Examiner*—Lun-Yi Lao
*Assistant Examiner*—Gregory J Tryder
(74) *Attorney, Agent, or Firm*—Ked & Associates LLP

(57) ABSTRACT

The present invention relates to a plasma display panel, in particular to a plasma display apparatus and driving method of same, wherein the bightness of sustain light generated by a sustain pulse by performing floating either a scan electrode or a sustain electrode during a sustain period, thereby increasing the driving efficiency of the plasma display apparatus. A plasma display apparatus according to an aspect of the present invention comprises a plasma display panel comprising a first electrode and a second electrode; and a controller for applying an auxiliary discharge pulse to the second electrode, when a sustain pulse is applied to the first electrode, during a sustain period.

26 Claims, 16 Drawing Sheets

U.S. PATENT DOCUMENTS

2002/0154074 A1* 10/2002 Lee et al. ..... 345/60
2003/0117345 A1* 6/2003 Yamamoto et al. ..... 345/60
2003/0146919 A1* 8/2003 Kawashima et al. ..... 345/609
2003/0179160 A1* 9/2003 Yamamoto et al. ..... 345/60
2003/0201965 A1* 10/2003 Sunohara et al. ..... 345/100
2004/0001035 A1* 1/2004 Awamoto et al. ..... 345/60
2004/0095294 A1* 5/2004 Yamada ..... 345/60
2004/0252082 A1* 12/2004 Lacoste et al. ..... 345/63
2004/0257304 A1* 12/2004 Yamamoto et al. ..... 345/60
2005/0093779 A1* 5/2005 Kim et al. ..... 345/60
2006/0125406 A1* 6/2006 Lin et al. ..... 315/169.1
2006/0158390 A1* 7/2006 Hashimoto et al. ..... 345/67
2006/0256044 A1* 11/2006 Yamada ..... 345/67

FOREIGN PATENT DOCUMENTS

KR 10-2003-0006436 1/2003
KR 10-2005-0040559 A 5/2005

OTHER PUBLICATIONS

Wu, T.F. et al., "PDP Sustainers with Reduced Current Stress and Sensitivity to Parasitic and Distributed Components," XP010559197; ISBN:0-7803-7067-8.
European Office Action dated Feb. 3, 2009.
Korean Official Gazette dated Jun. 2, 2007.

* cited by examiner

PLASMA DISPLAY APPARATUS AND DRIVING METHOD OF THE SAME

This application claims the benefit of Korean Patent Application No. 10-2005-0069154, filed on Jul. 28, 2005, which is hereby incorporated by reference for all purposes as if fully set forth herein.

BACKGROUND OF THE INVENTION

1. Field of the Invention

This document relates to a plasma display panel, in particular to a plasma display apparatus and driving method of same, wherein the bightness of sustain light generated by a sustain pulse by performing floating either a scan electrode or a sustain electrode during a sustain period, thereby increasing the driving efficiency of the plasma display apparatus.

2. Description of the Background Art

Generally, in a plasma display panel, barrier ribs formed between a front substrate and a rear substrate form unit or discharge cells. Each of the cells is filled with a main discharge gas, such as neon (Ne), helium (He), or a mixture of Ne and He, and an inert gas containing a small amount of xenon. When it is discharged by a high frequency voltage, the inert gas generates vacuum ultraviolet rays, which thereby cause phosphors formed between the barrier ribs to emit light, thus displaying an image. Because the plasma display panel can be made with a thin and/or slim form, it has attracted attention as a next-generation display device.

FIG. 1 is a perspective view illustrating the configuration of a related art plasma display panel.

As shown in FIG. 1, in the plasma display panel, a front panel 100 and a rear panel 110 are coupled in parallel with each other depart from a predetermined distance. In the front panel 100, a plurality of sustain electrode pairs formed by a pair of a scan electrode 102 and a sustain electrode 103 are arranged on a front substrate 101. In the rear panel 110, a plurality of address electrodes 113 are arranged to intersect the plurality of sustain electrode pairs on a rear substrate 111.

The front panel 100 comprises pairs of the scan electrode 102 and the sustain electrode 103. The scan electrode 102 and the sustain electrode 103 perform reciprocal discharges in a discharge cell and sustain light emitting of the cell. The scan electrode 102 and the sustain electrode 103 are provided with a transparent electrode (a) made of a transparent ITO material and a bus electrode (b) made of a metallic material. The scan electrode 102 and the sustain electrode 103 are covered with one or more upper dielectric layers 104 to limit discharge current and provide insulation among the electrode pairs. A protection layer 105 having magnesium oxide (MgO) deposited thereon in order to facilitate a discharge condition is formed on top of the upper dielectric layer 104.

In the rear panel 110, barrier ribs 112 are arranged in the form of a stripe pattern (or a well type), while a plurality of discharge spaces or discharge cells are formed in parallel. Furthermore, a plurality of address electrodes 113 for performing an address discharge to generate vacuum ultraviolet rays are disposed parallel to the barrier ribs 112. The top surface of the rear panel 110 is coated with R, G, and B phosphors 114 for emitting visible rays for an image display when an address discharge is carried out. A lower dielectric layer 115 is formed between the address electrodes 113 and the phosphors 114 for protecting the address electrodes 113.

A plurality of discharge cells are formed with a matrix arrangement structure in the plasma display panel having the configuration described above. Such a discharge cells are formed in the point where the scan electrode or the sustain electrode intersects the address electrode.

FIG. 2 is a diagram illustrating the arrangement of electrodes of a related art plasma display panel.

As shown in FIG. 2, in the related art plasma display panel 200, scan electrodes Y1~Yn are disposed in parallel with the sustain electrodes Z1·Zn, while address electrodes X1·Xm are disposed to intersect the sacn electrodes Y1~Yn and the sustain electrodes Z1~Zn.

A driving apparatus is coupled to the plasma display panel 200 having the configuration described above for applying given driving signals to each of the electrodes. Accordingly, due to the given driving signals by the driving apparatus, an image can be displayed. As described above, the apparatus having a driver coupled to the plasma display panel is called as plasma display apparatus.

Implementing gray scale in a plasma display apparatus having such configuration will be described in FIG. 3.

FIG. 3 illustrates a method for implementing image gradation or gray scale in a related art plasma display apparatus.

As illustrated in FIG. 3, a frame is divided into a plurality of sub-fields having a different number of emission times. Each sub-field is subdivided into a reset period (RPD) for initializing all the cells, an address period (APD) for selecting the cell(s) to be discharged, and a sustain period (SPD) for implementing the gray scale according to the number of discharges. For example, if an image with 256 gradation levels is to be displayed, the frame period (for example, 16.67 ms) corresponding to 1/60 second is divided into eight sub-fields SF1 to SF8, and each of the eight sub-fields SF1 to SF8 are subdivided into a reset period, an address period and a sustain period, as illustrated in FIG. 3.

The reset and address period is the same for every sub-field. The address discharge for selecting a cell to be discharged is performed by the voltage difference between the transparent electrodes that are address electrode X and the scan electrode Y. The sustain period increases by a ratio of $2^n$ (where, n=0, 1, 2, 3, 4, 5, 6, 7) for each sub-field SF1 to SF8. Since the sustain period varies from one sub-field to the next, a specific grey level is achieved by controlling sustain periods, i.e., the number of the sustain discharges.

FIG. 4 illustrates a driving waveform according to a related art method for driving a plasma display panel.

As shown, during a given sub-field, the waveforms associated with the X, Y, and Z electrodes are divided into a reset period for initializing all the cells, an address period for selecting the cells to be discharged, a sustain period for maintaining discharging of the selected cells, and an erase period for eliminating wall charges within each of the discharge cells.

The reset period is further divided into a set-up and set-down period. During the set-up period, a ramp-up waveform (Ramp-up) is applied to all the scan electrodes at the same time. Due to the ramp-up waveform, a dark discharge is occurred within all the discharge cells. This results in wall charges of a positive polarity being built up on the address electrodes X and the sustain electrodes Z, and wall charges of a negative polarity being built up on the scan electrodes Y.

During the set-down period, a ramp-down waveform (Ramp-down), which falls from a positive polarity voltage lower than the peak voltage of the ramp-up waveform to a given voltage lower than a ground level voltage, is applied to all the scan electrode at the same time, causing a weak erase discharge within the cells to sufficiently erase wall charges excessively accumulated in the scan electrodes. Furthermore, the remaining wall charges are uniform inside the cells to the extent that the address discharge can be stably performed.

During the address period, a scan pulse with a negative polarity is applied sequentially to the scan electrodes, and a data pulse with a positive polarity is selectively applied to specific address electrodes in synchronization with the scan pulse. As the voltage difference between the scan pulse and the data pulse is added to the wall voltage generated during the reset period, an address discharge is generated in the cells to which the data pulse is applied. A wall charge is formed inside the selected cells such that when a sustain voltage Vs is applied a discharge occurs. A positive polarity voltage Vz is applied to the sustain electrodes so that erroneous discharge may not occur with the scan electrode by reducing the voltage difference between the sustain electrodes and the scan electrodes during the set-down period and the address period.

During the sustain period, a sustain pulse is alternately applied to the scan electrodes and the sustain electrodes. Every time a sustain pulse is applied, a sustain discharge or display discharge is generated by adding the wall voltage to the sustain pulse voltage in the cells selected during the address period.

Finally, during the erase period, (i.e., after the sustain discharge is completed) an erase ramp waveform (Ramp-ers) having a small pulse width and a low voltage level, is applied to the sustain electrodes to erase the remaining wall charges within all the cells.

Sustain pulses applied during the sustain period in a plasma display apparatus with a related art driving pulse will be described in FIG. 5.

FIG. 5 illustrates a sustain pulse applied during a sustain period in a related art driving waveform.

As shown in FIG. 5, a sustain discharge is occurred by the sustain pulse applied during a sustain period according to a related art driving method. In other words, when a sustain voltage Vs is applied to a scan electrode Y, while a ground voltage level GND is applied to a sustain electrode Z, the sustain discharge is occurred by the scan electrode Y. On the other hand, when a sustain voltage Vs is applied to the sustain electrode Z, while the ground voltage level GND is applied to the scan electrode Y, the sustain discharge is occurred by the sustain electrode Z. Generally, such sustain pulse is alternately applied to the scan electrode Y and the sustain electrode Z.

The sustain pulse described above rises with a given slope during a voltage rising period ER-Up Time, falls with a given slope during a voltage falling period ER-Down Time. The voltage rising period, for example, as shown in FIG. 5, is a period where a voltage rises from the ground voltage level GND to the sustain voltage level. The voltage falling period is a period where a voltage falls from the sustain voltage level to the ground voltage level GND.

A sustain light generated by a sustain pulse of a related art driving pulse will be described in FIG. 6.

FIG. 6 illustrates a sustain light generated by the sustain pulse according to the related art driving method.

As shown in FIG. 6, by the sustain pulse according to the related art driving method, a sustain light is generated in the neighborhood of the time point where the voltage of sustain pulse rises ER-Up Time or where the voltage of sustain pulse reaches a sustain voltage Vs.

The light waveform of the sustain light generated by the sustain pulse according to the related art has a great magnitude and a narrow width, which means that the amount of an instant light is great but the absolute amount of the light is small. Hence, there is a drawback in that the luminance for driving is decreased as the amount of the sustain light generated by one sustain pulse is relatively small.

SUMMARY OF THE INVENTION

Accordingly, an object of the present invention is to solve at least the problems and disadvantages of the background art.

The embodiment of the present invention provides a plasma display apparatus and driving method of same, by improving pulse applied during a sustain period to increase the magnitude of light, thereby increasing the luminance characteristic.

A plasma display apparatus according to an aspect of the present invention comprises a plasma display panel comprising a first electrode and a second electrode; and a controller for applying an auxiliary discharge pulse to the second electrode, when a sustain pulse is applied to the first electrode, during a sustain period.

A plasma display apparatus according to another aspect of the present invention comprises a plasma display panel comprising a first electrode and a second electrode; and a controller for generating an auxiliary discharge pulse by floating the second electrode, when a sustain pulse is applied to the first electrode, during a sustain period.

A method of driving plasma display apparatus according to still another aspect of the present invention comprises the steps of applying a sustain pulse to a first electrode and a second electrode, during a sustain period; and performing floating the second electrode, when the sustain pulse is applied to the first electrode.

The embodiment of the present invention, wherein the magnitude of sustain light generated by one sustain pulse is increased, by performing floating either a scan electrode or a sustain electrode during a sustain period, increases the luminance characteristic.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Figure 1:
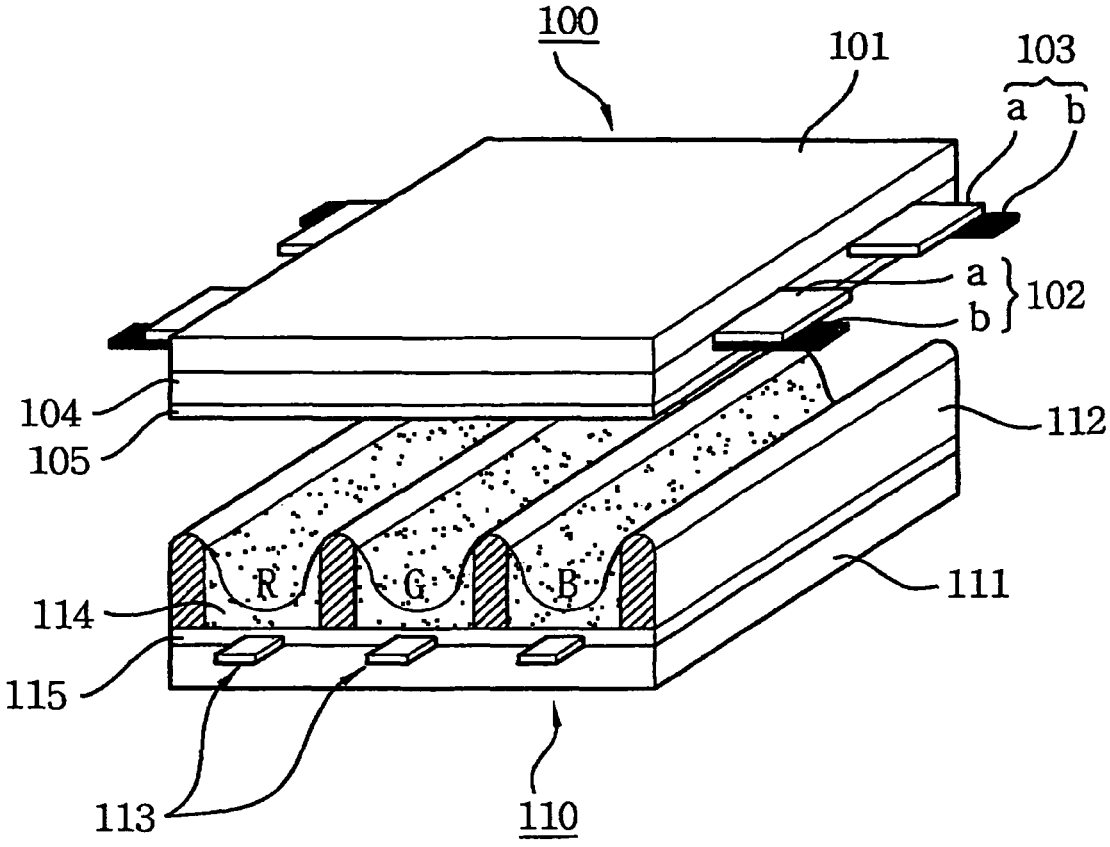
FIG. 1 is a perspective view illustrating the configuration of a related art plasma display panel.
Figure 2:
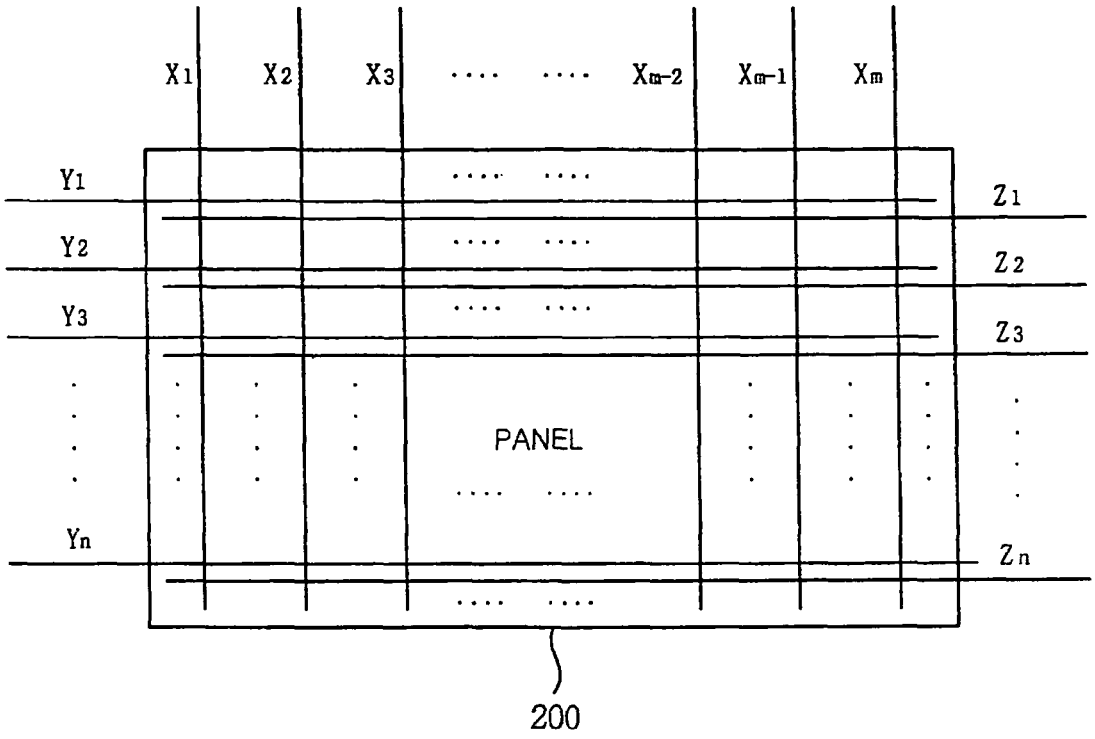
FIG. 2 is a diagram illustrating the arrangement of electrodes of a related art plasma display panel.
Figure 3:
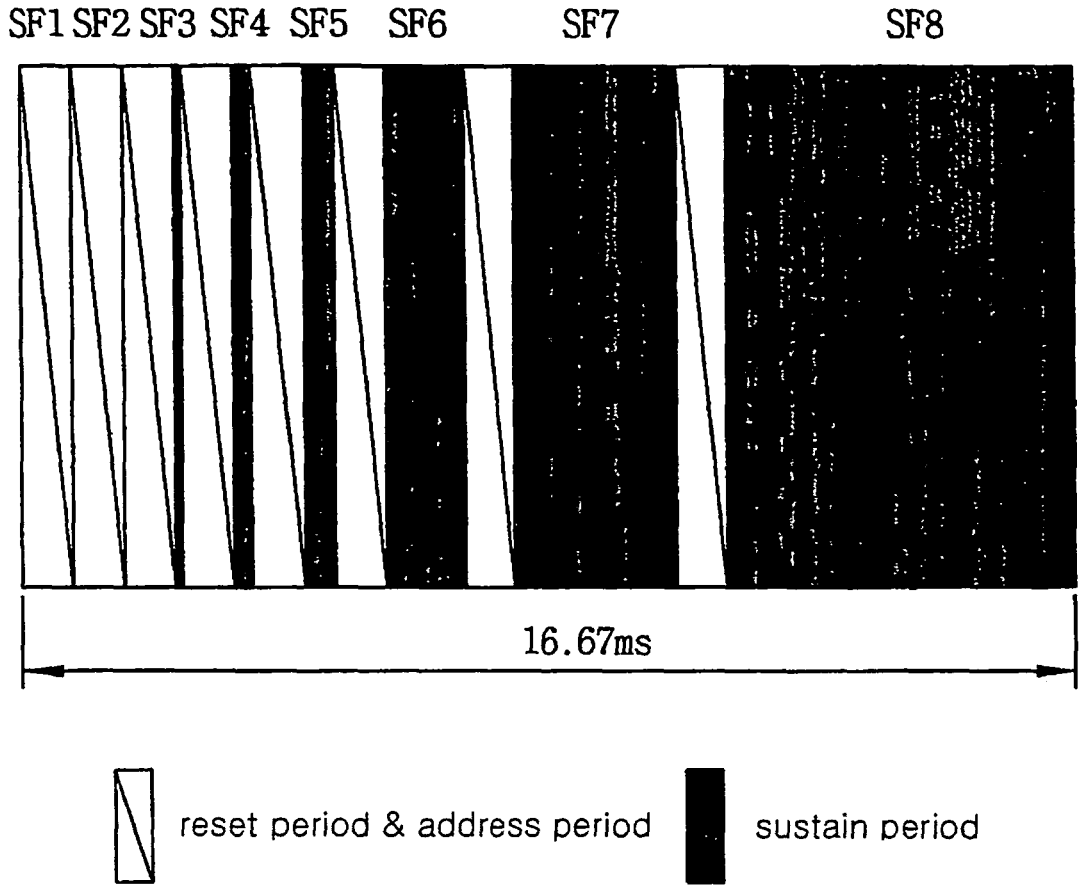
FIG. 3 illustrates a method for implementing image gradation or gray scale in a related art plasma display apparatus.
Figure 4:
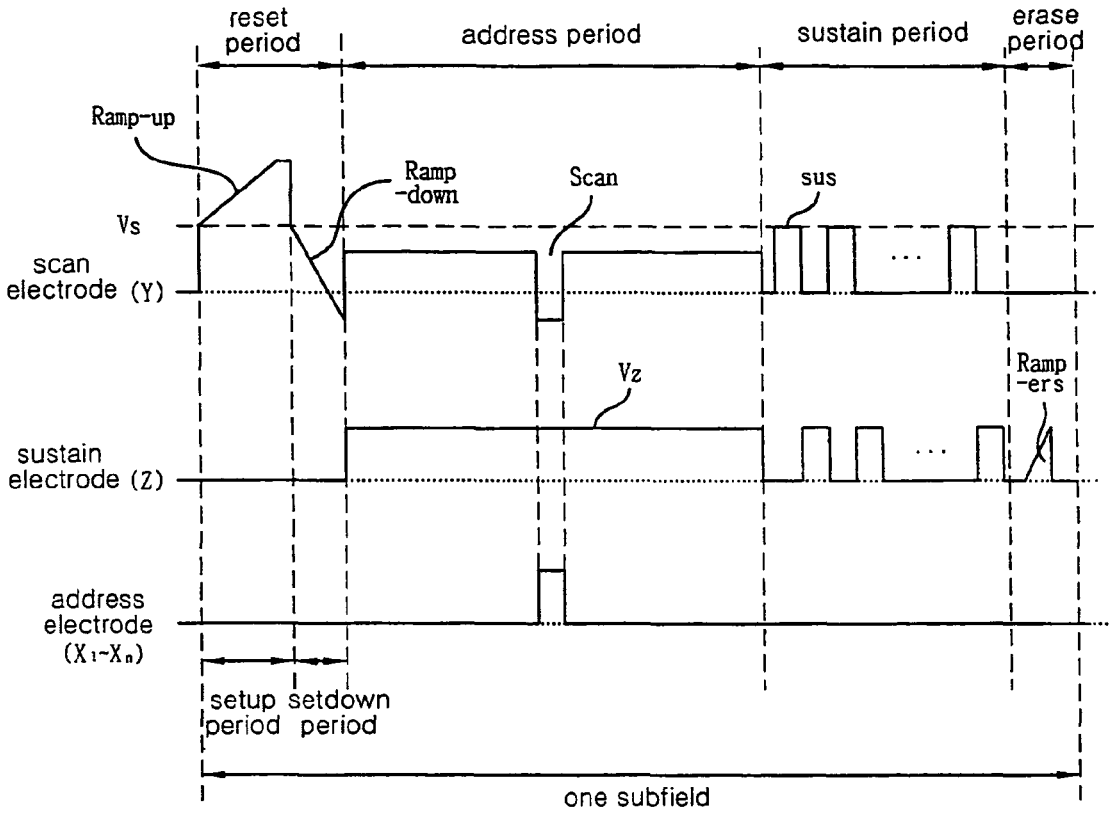
FIG. 4 illustrates a driving waveform according to a related art method for driving a plasma display panel.
Figure 5:
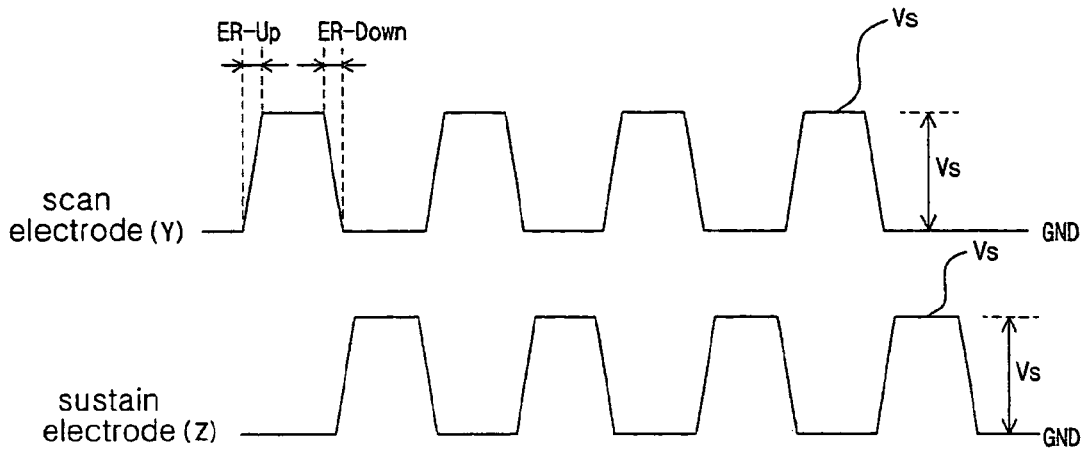
FIG. 5 illustrates a sustain pulse applied during a sustain period in a related art driving waveform.
Figure 6:
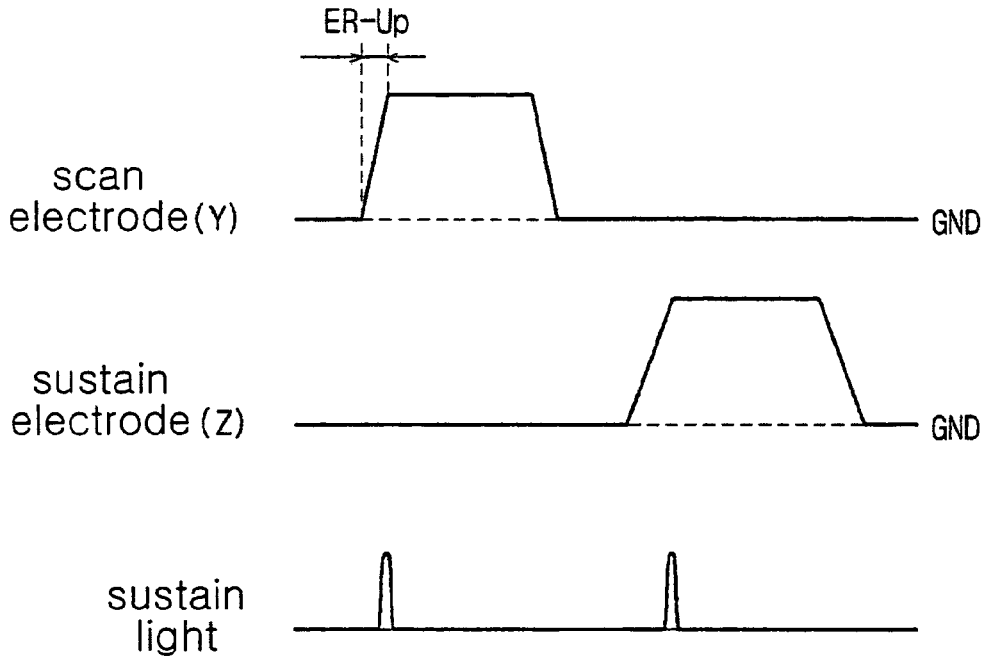
FIG. 6 illustrates a sustain light generated by the sustain pulse according to the related art driving method.

Reference will now be made in detail to embodiments of the present invention, examples of which are illustrated in the accompanying drawings.

A plasma display apparatus according to an aspect of the present invention comprises a plasma display panel comprising a first electrode and a second electrode; and a controller for applying an auxiliary discharge pulse to the second electrode, when a sustain pulse is applied to the first electrode, during a sustain period.

The auxiliary discharge pulse is applied at the time point when there is about a maximum voltage difference between the first electrode and the second electrode.

The auxiliary discharge pulse is formed by floating the second electrode.

The duration of the floating ranges from 100 ns to 200 ns.

The auxiliary discharge pulse is applied in the interval between the time point when the sustain voltage reaches 60% of the maximum sustain voltage and 500 ns after the time point when the sustain voltage reaches the maximum sustain voltage.

The sustain pulse is alternately applied to the first electrode and the second electrode.

The sustain pulses applied to the first electrode and the second electrode are simultaneously applied for a predetermined time.

A plasma display apparatus according to another aspect of the present invention comprises a plasma display panel comprising a first electrode and a second electrode; and a controller for generating an auxiliary discharge pulse by floating the second electrode, when a sustain pulse is applied to the first electrode, during a sustain period.

The floating time point when the auxiliary discharge pulse is generated is the time point when there is about a maximum voltage difference between the first electrode and the second electrode.

The duration of the floating ranges from 100 ns to 200 ns.

The auxiliary discharge pulse is generated in the interval between the time point when the sustain voltage reaches 60% of the maximum sustain voltage and 500 ns after the time point when the sustain voltage reaches the maximum sustain voltage.

The sustain pulse is alternately applied to the first electrode and the second electrode.

The sustain pulses applied to the first electrode and the second electrode are simultaneously applied for a predetermined time.

A method of driving plasma display apparatus according to still another aspect of the present invention comprises the steps of applying a sustain pulse to a first electrode and a second electrode, during a sustain period; and performing floating the second electrode, when the sustain pulse is applied to the first electrode.

The time point of the floating is the time point when there is about a maximum voltage difference between the first electrode and the second electrode.

The duration of the floating ranges from 100 ns to 200 ns.

The floating is happened in the interval between the time point when the sustain voltage reaches 60% of the maximum sustain voltage and 500 ns after the time point when the sustain voltage reaches the maximum sustain voltage.

The sustain pulse is alternately applied to the first electrode and the second electrode.

The sustain pulses applied to the first electrode and the second electrode are simultaneously applied for a predetermined time.

Hereinafter, exemplary embodiments of the present invention will be described in detail with reference to the attached drawings.

Figure 7A:
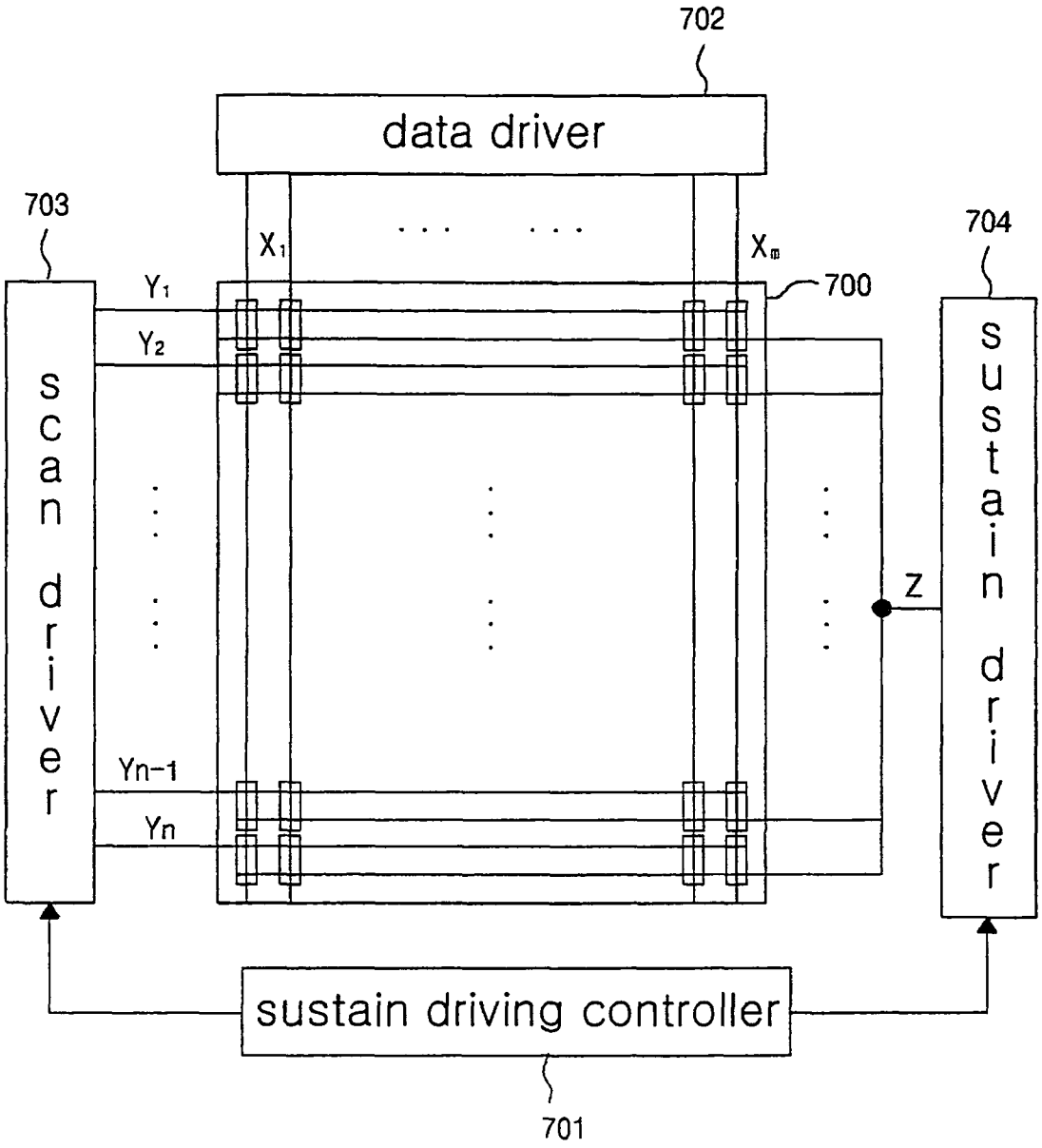
FIG. 7 is a diagram illustrating the configuration of plasma display panel according to embodiments of the present invention.

FIG. 7 is a diagram illustrating the configuration of a plasma display apparatus according to embodiments of the present invention.

As shown in FIG. 7, the plasma display apparatus according to embodiments of the present invention includes a plasma display panel 700 for displaying an image of frame, a data driver 702 for supplying data to an address electrode X formed on the plasma display panel 700, a scan driver 703 for driving a scan electrode Y, a sustain driver 704 for driving a sustain electrode Z that is a common electrode and a sustain driving controller 701 for controlling the scan driver 703 and the sustain driver 704 during a sustain period. The plasma display panel 700 includes a plurality of sustain electrodes comprising the scan electrode Y and the sustain electrode Z, a plurality of address electrodes X intersecting the scan electrode Y and the sustain electrode Z. The plasma display panel 700 for displays an image of frame which is a combination of at least one subfield where driving pulses are applied to the address electrodes X, the scan electrode Y and the sustain electrode Z during a reset period, an address period and the sustain period.

A front panel(not shown) and a rear panel(not shown) of the plasma display panel 700 are coalesced with each other at a given distance. A plurality of electrodes, for example, a plurality of sustain electrodes including the scan electrode Y and the sustain electrode Z are formed on the panel, the address electrodes X are formed on the panel to intersect the sustain electrodes including the scan electrode Y and the sustain electrode Z.

The scan driver 703, under the control of the timing controller (not shown), supplies a ramp-up waveform to the scan electrode Y during a setup period of a reset period, a ramp-down waveform to the scan electrode Y during a setdown period of a reset period. In addition, the scan driver 703, sequentially supplies a scan pulse Sp of scan voltage −Vy to the scan electrode Y during the address period, and supplies a sustain pulse (sus), under the control of the sustain driving controller 701, to the scan electrode Y during the sustain period.

The sustain driver 704, under the control of the timing controller (not shown), supplies a bias voltage (Vz) to the sustain electrodes Z during the set-down period and the address period. During the sustain period, under the control of the sustain driving controller 701, the sustain driver 704 operates alternately with the scan driver 703 to supply a sustain pulse SUS that is a driving pulse to the sustain electrodes Z.

The data driver 702 receives image data mapped for each sub-field by a sub-field mapping circuit (not shown) after being inverse-gamma corrected and error-diffused through an inverse gamma correction circuit (not shown), an error diffusion circuit (not shown). The data driver 702 supplies the data mapped for each sub-field to address electrodes $X_1$ to $X_m$.

The sustain driving controller 701 controls the scan driver 703 and the sustain driver 704 during the sustain period. Further, the sustain driving controller 701 supplies a light control pulse to either the scan electrode Y or the sustain electrode Z during the sustain period, by controlling the scan driver 703 and the sustain driver 704. In other words, the sustain driving controller 701 supplies the light control pulse different from a sustain pulse to a second electrode, while the sustain pulse is applied to a first electrode, during the sustain period, by controlling the scan driver 703 and the sustain driver 704.

The sustain driving controller 701 may make a second electrode have the light control pulse when the voltage of the sustain pulse applied to the first electrode rises.

Generally, the light control pulse is a pulse that is generated by floating one of the scan electrode Y or the sustain electrode Z during the sustain period.

The floating means a phenomenon that a voltage is induced in one of the scan electrode Y or the sustain electrode Z, although a given voltage is not applied to one of the electrodes anymore after the given voltage is applied to one of the electrodes.

In other words, the sustain driving controller 701 performs floating one of the scan electrode Y or the sustain electrode Z during a given period by controlling the scan driver 703 and the sustain driver 704, thereby generating the light control pulse. Then, the sustain driving controller 701 supplies the light control pulse to one of the scan electrode Y or the sustain electrode Z during a sustain period.

Further, the sustain driving controller 701 may supply the light control pulse to one of the scan electrode Y or the sustain electrode Z by generating an additional light control pulse that is not generated by floating.

A light control pulse generated by the sustain driving controller 701 will be described in FIG. 8.

Figure 8:
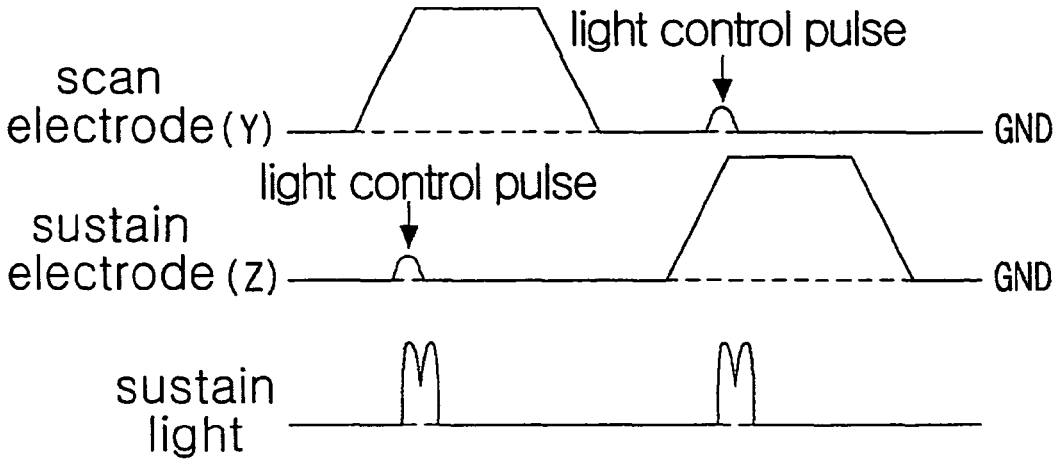
FIG. 8 is a diagram illustrating the light control pulse supplied by the control of the sustain driving controller in FIG. 7.

FIG. 8 is a diagram illustrating the light control pulse supplied by the control of the sustain driving controller in FIG. 7.

Referring FIG. 8, a light control pulse is applied to either a scan electrode Y or a sustain electrode Z during a sustain period. As shown in FIG. 8, the light control pulse is applied to a scan electrode Y and a sustain electrode Z alternately. For example, the light control pulse is applied to the sustain electrode Z in a given point when a sustain pulse is applied to the scan electrode Y, while the light control pulse is applied to the scan electrode Y in a given point when the sustain pulse is applied to the sustain electrode Z.

At this time, the given point is a point where the voltage difference between the scan electrode Y and the sustain electrode approximately becomes maximum.

Accordingly, a double discharge is occurred during the sustain period. In other words, the amount of the light generated by one sustain pulse increases to increase the total amount of the light generated during sustain period.

The more detailed operation of the plasma display panel according to the embodiments of the present invention will be described by way of explanation of driving method of the same.

FIG. 9*a* through FIG. 9*d* illustrates a first embodiment of a method for driving plasma display apparatus of the present invention.

Referring FIG. 9*a* through FIG. 9*d*, a positive sustain pulse is applied to a scan electrode Y and a sustain electrode Z during a sustain period, while a light control pulse is applied to either the scan electrode Y or the sustain electrode Z during the sustain period. For applying the light control pulse, either the scan electrode Y or the sustain electrode Z is set to be floating state in a given period. In other words, the light control pulse supplied during the sustain period is generated by floating either the scan electrode Y or the sustain electrode Z.

It is desirable that the floating of either the scan electrode Y or the sustain electrode Z is controlled depending on Average Picture Level APL.

Figure 9A:
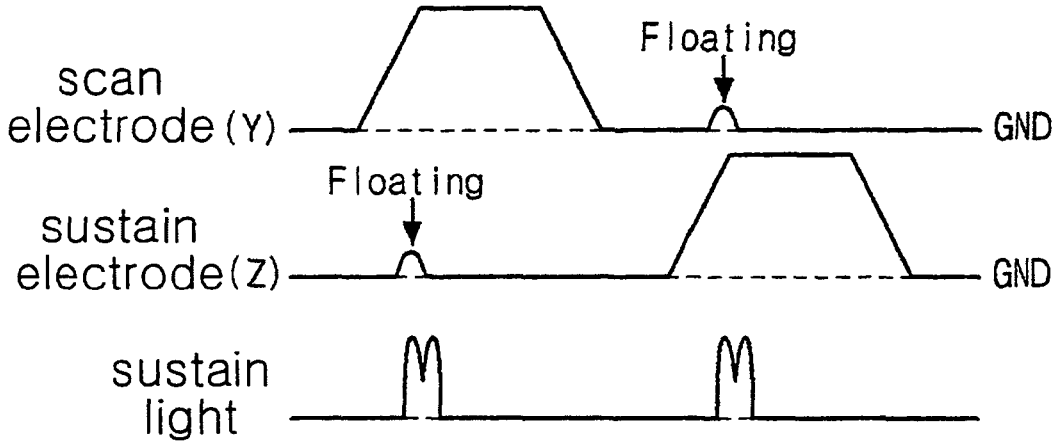
FIG. 9*a* through FIG. 9*d* illustrates a first embodiment of a method for driving plasma display apparatus of the present invention.

For example, as shown in FIG. 9*a*, a positive sustain pulse is alternately applied to the scan electrode Y or the sustain electrode Z, floating the sustain electrode Z in the given point when the sustain pulse is applied to the scan electrode Y. When the sustain pulse applied to the scan electrode Y and the sustain electrode Z rises from a ground level GND to a sustain voltage Vs respectively, the connection between the sustain electrode maintaining the ground level GND and the ground is cut off in the given point, while the sustain pulse applied to the scan electrode Y rises from the ground level GND to a sustain voltage Vs. Thus, the intended floating can be occurred.

Further, when the sustain pulse is applied to the sustain electrode Z, the scan electrode Y is set to be floating in the given period in the same method as the sustain electrode Z performs floating.

As described above, the given point is a point where the voltage difference between the scan electrode Y and the sustain electrode approximately becomes maximum.

It is desirable that the floating of either the scan electrode Y or the sustain electrode Z is alternately performed during the given period.

Thus, the light control pulse is generated by floating either the scan electrode Y or the sustain electrode Z. Such light control pulse is supplied during the sustain period.

It is desirable that period of the floating is uniformly maintained. That is, It is desirable that the interval between the point of floating the scan electrode Y and the point of floating the sustain electrode Z is uniformly maintained.

Figure 9B:
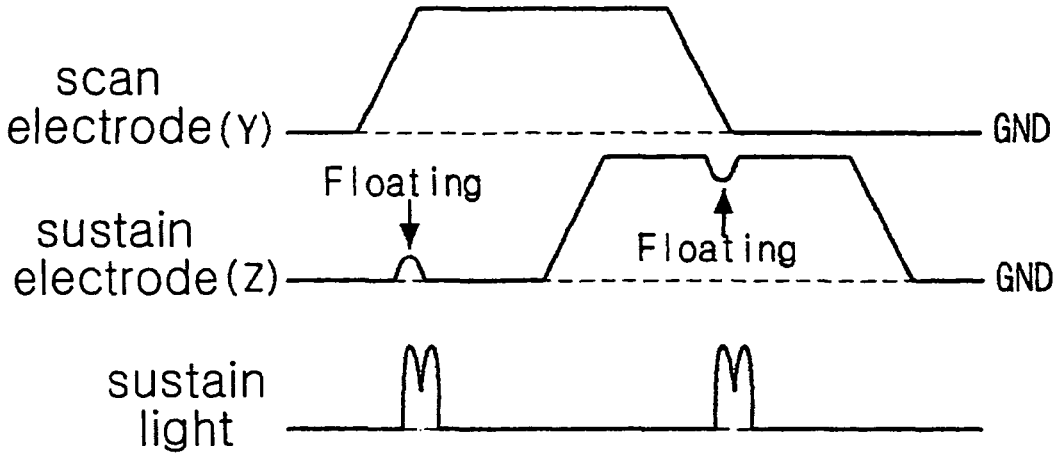

As shown in FIG. 9*b*, a positive sustain pulse is alternately applied to the scan electrode Y and the sustain electrode Z. The sustain pulse applied to the scan electrode Y and the sustain pulse applied to the sustain electrode Z are overlapped each other, while the sustain electrode Z is set to be floating in the given period when the sustain pulse is applied to the scan electrode Y.

As shown in FIG. 9*b*, different with FIG. 9*a* described above, the floating is only occurred in the sustain electrode Z between the scan electrode Y and the sustain electrode Z. The sustain electrode Z is set to be floating in the given point, when the sustain pulse applied to the scan electrode Y rises from the ground level GND to the sustain voltage Vs. The sustain electrode Z is set to be floating in the given point, when the sustain pulse applied to the scan electrode Y falls from the sustain voltage Vs to the ground level GND.

Figure 9C:
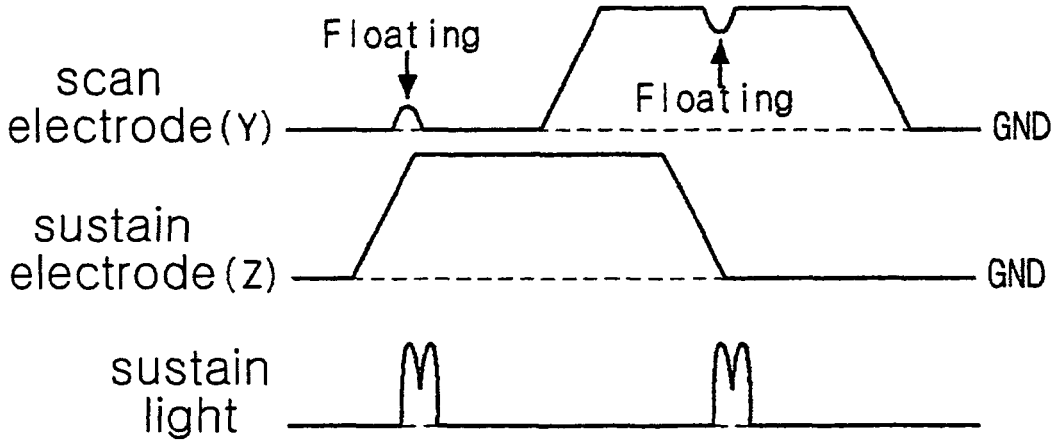

Referring FIG. 9*c*, same as FIG. 9*b*, the positive sustain pulse is alternately applied to the scan electrode Y and the sustain electrode Z. The sustain pulse applied to the scan electrode Y and the sustain pulse applied to the sustain electrode Z are overlapped each other As shown in FIG. 9*c*, different with FIG. 9*b*, the sustain pulse applied to the scan electrode Y overlaps the latter part of the sustain pulse applied to the sustain electrode Z. In a pair of sustain pulse, the sustain pulse applied to the scan electrode Y lags the sustain pulse applied to the sustain electrode Z.

In this case, when the sustain pulse applied to the sustain electrode Z, the scan electrode Y is set to be floating in the given point. As shown in FIG. 9*c*, different with FIG. 9*b*, the scan electrode Y is only set to be floating between the scan electrode Y and the sustain electrode Z.

In detail, the scan electrode Y is set to be floating in the given point, when the sustain pulse applied to the sustain electrode Z rises from the ground level GND to the sustain voltage Vs. The scan electrode Y is set to be floating in the given point, when the sustain pulse applied to the sustain electrode Z falls from the sustain voltage Vs to the ground level GND.

Figure 9D:
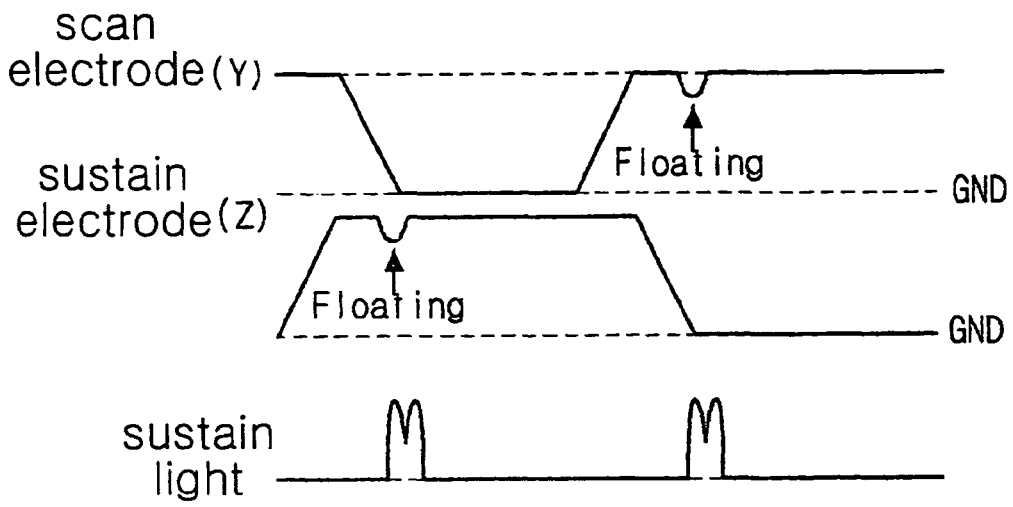

Referring FIG. 9*d*, same as FIG. 9*a*, the scan electrode Y and the sustain electrode Z is alternately set to be floating during the sustain period.

As shown in FIG. 9*d*, different with FIG. 9*a*, the floating is performed by cut off the electrical connection between the sustain electrode Z maintaining a given positive voltage such as sustain voltage Vs and the sustain voltage source supplying the sustain voltage Vs in a given point, when the sustain pulse applied to the scan electrode Y falls from the sustain voltage Vs to the ground level GND.

When the sustain pulse applied to the sustain electrode Z, the scan electrode Y is set to be floating in the given point. It is performed in the same method as the sustain electrode Z is set to be floating in the given point, when the sustain pulse applied to the scan electrode Y falls from the sustain voltage Vs to the ground level GND.

As shown in FIG. 9*a* to FIG. 9*d*, a double discharge can be occurred by floating either the scan electrode Y or the sustain electrode Z.

Such double discharge may be generated by increasing the voltage rising time of sustain pulse ER-Up Time applied during the sustain period.

However, as the voltage rising time of sustain pulse varies with the load of the plasma display panel, there is a problem in that the method of controlling the voltage rising time of sustain pulse to generate the double discharge has a non-stability.

For example, if the number of discharge cells turned on in the plasma display panel is relatively small, then the load value of the panel becomes small. In such a case having small number of turn-on discharge cells, there are relatively small number of turn-on discharge cells having a given capacitance equivalently. In result, the total equivalent capacitance of the plasma display panel is considered as small.

Accordingly, the voltage rising time of sustain pulse is decreased due to Equation 1. In other words, when the number of discharge cells turned on among the discharge cells of the plasma display panel is relatively small, the voltage rising time of sustain pulse becomes relatively smaller.

$$I(\text{current})=C(\text{current})\times dV/dt \qquad \text{[Equation 1]}$$

Referring Equation 1, if the supplied current is constant, the differentiation of voltage V per time t dV/dt is determined by the capacitance C.

Hence, if the capacitance C is increased, the differentiation of voltage V per time t dV/dt is decreased. On the other hand, if the capacitance C is decreased, the differentiation of voltage V per time t dV/dt is increased. In other words, if the capacitance C is increased, the sustain pulse voltage rises or falls with a small slope, while, if the capacitance C is decreased, the sustain pulse voltage rises or falls with a great slope.

Thus, when the number of discharge cells turned on among the discharge cells of the plasma display panel is relatively small, the voltage rising time of sustain pulse determined by the Equation 1 becomes relatively small.

Accordingly, although the voltage rising time of sustain pulse is relatively elongated to perform the double discharge in the related art driving method, if the number of discharge cells turned on in the plasma display panel is relatively small, the voltage rising time of sustain pulse determined by the Equation 1 becomes relatively small. Hence, the double discharge is not occurred.

Accordingly, by floating either the scan electrode Y or the sustain electrode Z depending on the average picture level APL, the double discharge can be easily occurred in the level where the double discharge is difficult to occur.

The average picture level APL described above will be described with FIG. 10.

Figure 10:
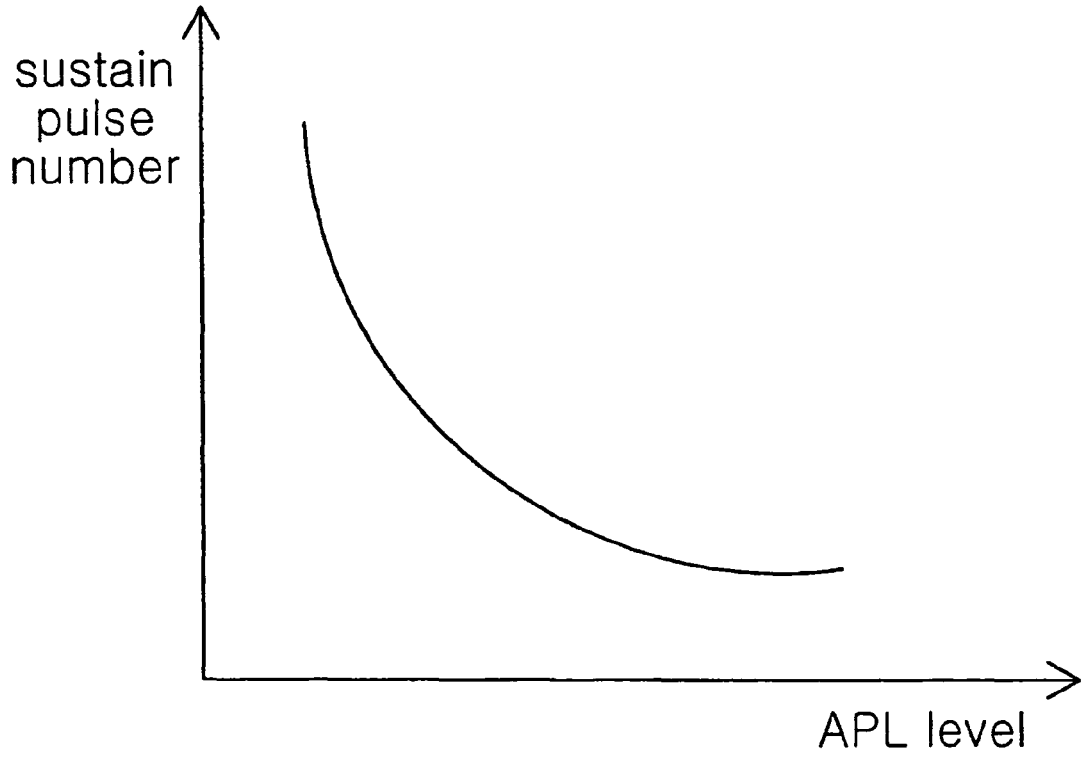
FIG. 10 is a diagram for explanation of average picture level APL.

FIG. 10 is a diagram for explanation of average picture level APL.

As shown in FIG. 10, as average picture level APL determined by the number of discharge cells turned on among the discharge cells of the plasma display panel is increased, the number of sustain pulse is decreased. As average picture level APL is decreased, the number of sustain pulse is increased.

For example, if an image is displayed in the relatively large area on the screen of the plasma display panel, that is, if the area displaying an image is relatively large(in this case, the APL level is relatively great), the number of discharge cells for displaying an image is relatively great. Accordingly, by decreasing the number of the sustain pulse per unit gray scale supplied to each of the discharge cell for displaying an image, the amount of the total power consumption of the plasma display panel can be decreased.

On the other hand, if an image is displayed in the relatively small area on the screen of the plasma display panel, that is, if the area displaying an image is relatively small (in this case, the APL level is relatively small), the number of discharge cells for displaying an image is relatively small. Hence, the number of the sustain pulse per unit gray scale supplied to each of the discharge cell for displaying an image is relatively great. Accordingly, the luminance of the area displaying an image is increased, thereby the rapid increase of the amount of the total power consumption can be prevented.

As described, when the image is displayed in a relatively large area in the screen of the plasma display panel, the number of the sustain pulse per unit gray scale supplied to each of the discharge cell is decreased to decrease the power consumption. When the image is displayed in a relatively small area in the screen of the plasma display panel, the number of the sustain pulse per unit gray scale supplied to each of the discharge cell is increased to compensate the total luminance. Thus, the decrease of the luminance of the entire plasma display panel is prevented and can decrease the power consumption As described above, when the APL is relatively high, the number of discharge cells turned on in the plasma display panel is relatively great, the voltage rising time of sustain pulse is relatively elongated. When the number of discharge cells turned on in the plasma display panel is relatively great, the total equivalent capacitance of one plasma display panel is relatively great. Thus, the differentiation of voltage V per time t dV/dt is decreased. On the other hand, if the capacitance C is decreased, the differentiation of voltage V per time t dV/dt determined by the Equation 1 above, such as the voltage rising time of sustain pulse is relatively elongated.

Accordingly, as described above, when the APL is relatively high, the voltage rising time of sustain pulse is relatively elongated to generate the double discharge with one sustain pulse.

However, when the APL is relatively low, the number of discharge cells turned on in the plasma display panel is relatively small, the total equivalent capacitance of one plasma display panel is relatively small. Thus, the voltage rising time of sustain pulse determined by the Equation 1 above is relatively decreased.

Therefore, as described above, in case the average picture level is relatively low, the double discharge is difficult to generate although the voltage rising time of sustain pulse is elongated by controlling the driver circuit, because the capacitance of the plasma display panel, that is, the magnitude of the total equivalent capacitance is small.

Therefore, in the driving method of the above-described plasma display apparatus, in order to make the generation of the double discharge facilitated in case the average picture level falls down below the threshold level, either the scan electrode Y or the sustain electrode Z is floated during the sustain period.

That is, in the first preferred embodiment, by floating either the scan electrode Y or the sustain electrode Z during the sustain period, it makes the generation of the double discharge facilitated. Accordingly, by increasing the amount of the sustain light generated with one sustain pulse, the luminance characteristic is improved.

The threshold level is the standard for floating either the scan electrode Y or the sustain electrode Z during the sustain period to generate the double discharge. It is preferable that the threshold level is a level where the discharge cells less than 10% of the total discharge cells of the plasma display panel are turned on. That is, it is preferable that either the scan electrode Y or the sustain electrode Z is set to be floating during the sustain period in the average picture level where the discharge cell less than 10% of the total discharge cell of the plasma display panel are turned on.

More preferably, the threshold level is the level where the discharge cells less than 4% of the total discharge cells of the plasma display panel are turned on. That is, it is preferable that either the scan electrode Y or the sustain electrode Z is set to be floating during the sustain period in the average picture level where the discharge cell less than 4% of the total discharge cell of the plasma display panel are turned on.

Figure 11:
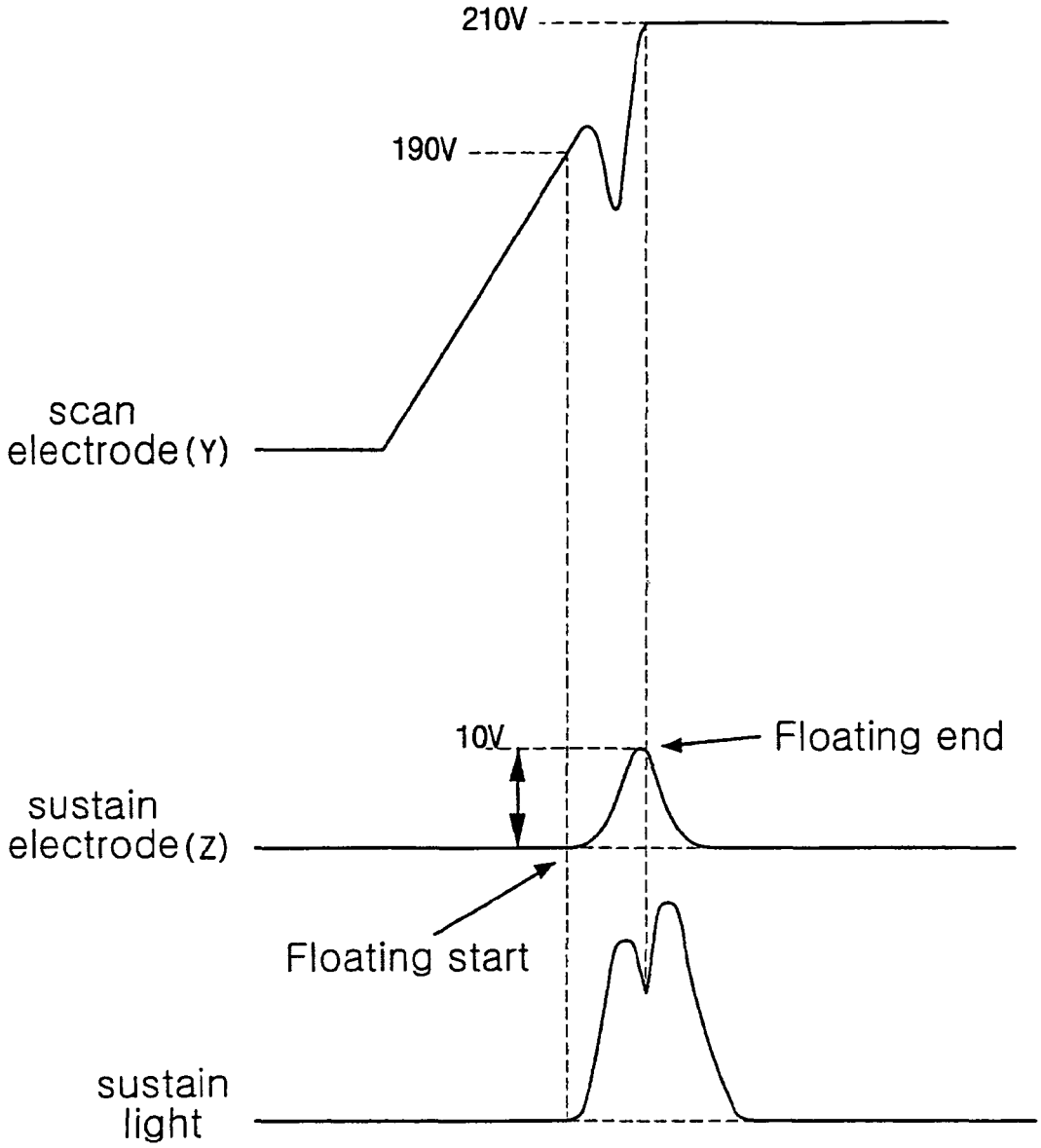
FIG. 11 is a drawing illustrating the process of generating a double discharge by floating either the scan electrode Y or the sustain electrode Z during the sustain period.

In this way, referring to FIG. 11, if it looks into about the process of causing the double discharge by floating either the scan electrode Y or the sustain electrode Z during the sustain period, the process is as follows:

FIG. 11 is a drawing illustrating the process of generating a double discharge by floating either the scan electrode Y or the sustain electrode Z during the sustain period.

As to FIG. 11, when the sustain electrode Z maintains the voltage of the ground level GND while the sustain pulse rising from the ground level GND to the sustain voltage Vs is supplied to the scan electrode Y as in FIG. 9*a*, the voltage of the sustain electrode Z maintaining the ground level GND associated with the rising sustain pulse supplied to the scan electrode Y rises, if the sustain electrode Z is set to be floating for the given period.

As described, the rate of the voltage of the sustain electrode Z associated with the rising sustain pulse supplied to the scan electrode Y is more little in comparison with the rate of rising of the sustain pulse supplied to the scan electrode (Y). For example, if the voltage of the sustain pulse supplied to the scan electrode Y rises as much as 20V for the given time in the state where the sustain electrode Z is in floating, the floated voltage of the sustain electrode Z rises as much as 10V.

In this case, assuming that the sustain electrode Z maintaining the ground level GND is set to be floating in the point of time when the sustain firing voltage in which the sustain discharge can be generated is 190V and the voltage of the sustain pulse supplied to the scan electrode Y is less than 190V, the voltage of the sustain electrode Z associated with the sustain pulse supplied to the scan electrode Y rises while the sustain electrode Z is floated.

In this way, the voltage of the sustain electrode Z associated with the sustain pulse supplied to the scan electrode Y rises with the rate which is smaller than the rate of the voltage rising of the sustain pulse supplied to the scan electrode Y. Accordingly, the voltage difference between the sustain electrode Z and the scan electrode Y exceeds the sustain firing voltage 190V, thereby the first discharge is generated.

The main source generating this first discharge is a discharge capacitance Cap of the driving circuit of the plasma display panel. The voltage of the sustain pulse supplied to the scan electrode Y provisionally descends while electric charge of the discharge gap are mostly used up by this first discharge. Thereafter, the sustain voltage Vs is supplied from the sustain voltage source and the voltage of the scan electrode Y again rises.

Here, in case the sustain voltage Vs is supplied from the sustain voltage source and is applied to the scan electrode Y, when the voltage of the scan electrode Y rises again, the secondary discharge is generated by terminating the floating the sustain electrode Z, that is, by connecting again the sustain electrode Z to the ground, as the voltage difference between the sustain electrode Z and the scan electrode Y exceeds again the sustain firing voltage 190V.

Through this process, the first discharge and the secondary discharge, that is, the double discharge are generated, increasing the amount of the sustain light generated with one sustain pulse to improve the luminance characteristic.

In the first preferred embodiment of the driving method of the plasma display apparatus according to the present invention described in the above, it showed the method for floating either the scan electrode Y or the sustain electrode Z, when either the scan electrode Y or sustain electrode Z was supplied with the sustain pulse having positive polarity during the sustain period. However, the present invention is applicable in the mode, which is different from the above, where the sustain discharge is generated by using the sustain pulse having negative polarity during the sustain period. Referring to FIGS. 12*a* through 12*d*, it will be described in detail.

FIGS. 12*a* through 12*d* are the drawing illustrating a second embodiment of the driving method of the plasma display apparatus according to the present invention.

As to the FIGS. 12*a* through 12*d*, in the second embodiment of the driving method of the plasma display apparatus according to the present invention, the sustain pulse having negative polarity is supplied during the sustain period. During the sustain period, where the sustain pulse having negative polarity is supplied, according to the average picture level APL, either the scan electrode Y or the sustain electrode Z is set to be floating for the given period.

Figure 12A:
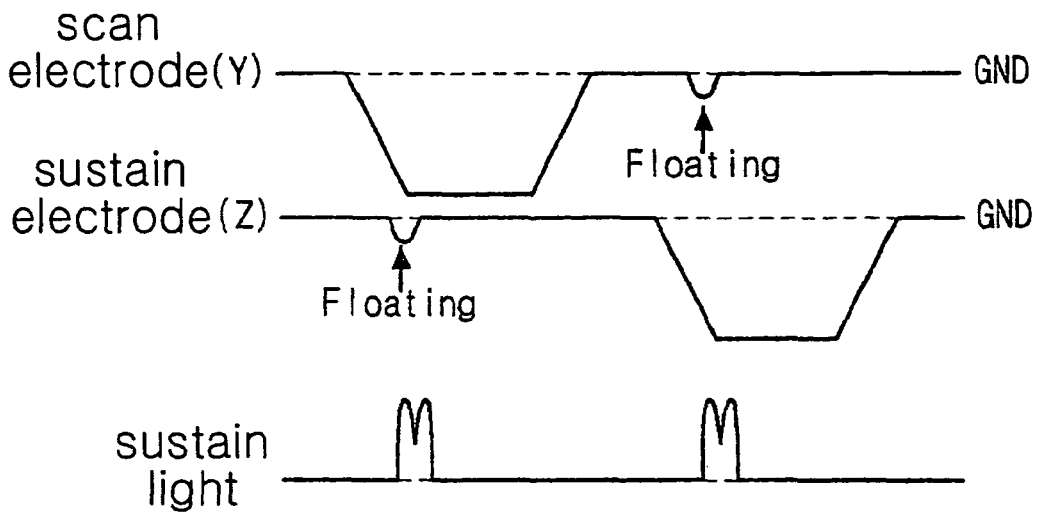
FIGS. 12*a* through 12*d* are the drawing illustrating a second embodiment of the driving method of the plasma display apparatus according to the present invention.

For example, as shown in FIG. 12*a*, a negative sustain pulse is alternately applied to the scan electrode Y or the sustain electrode Z, floating the sustain electrode Z in the given point when the sustain pulse is applied to the scan electrode Y. When the sustain pulse applied to the scan electrode Y and the sustain electrode Z falls from a ground level GND to a negative sustain voltage −Vs respectively, the connection between the sustain electrode maintaining the ground level GND and the ground is cut off in the given point, while the sustain pulse applied to the scan electrode Y falls from the ground level GND to the negative sustain voltage −Vs. Thus, the intended floating can be occurred.

Further, when the sustain pulse is applied to the sustain electrode Z, the scan electrode Y is set to be floating in the given period in the same method as the sustain electrode Z performs floating in a given point when the sustain pulse supplied to the scan electrode Y descends from the ground level GND to the negative sustain voltage −Vs.

Figure 12B:
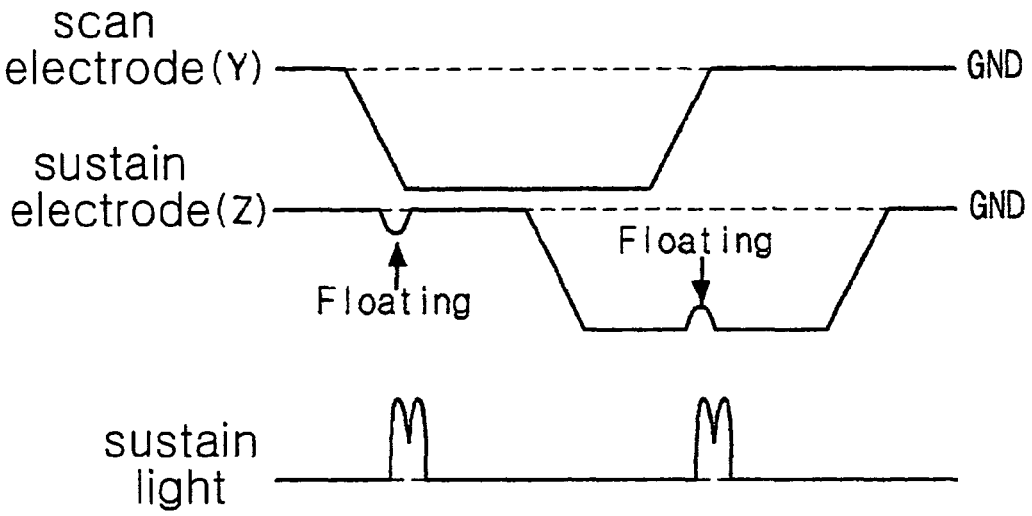

As shown in FIG. 12*b*, a negative sustain pulse is alternately applied to the scan electrode Y and the sustain electrode Z. The sustain pulse applied to the scan electrode Y and the sustain pulse applied to the sustain electrode Z are overlapped each other. The sustain electrode Z is set to be floating in the given point when the sustain pulse is applied to the scan electrode Y. Compared with FIG. 9*b*, FIG. 12*b* is only different in that the sustain pulse descends from the ground level GND to the negative sustain voltage −Vs, but it is substantially identical with FIG. 9*b* and the overlapped description is omitted.

Figure 12C:
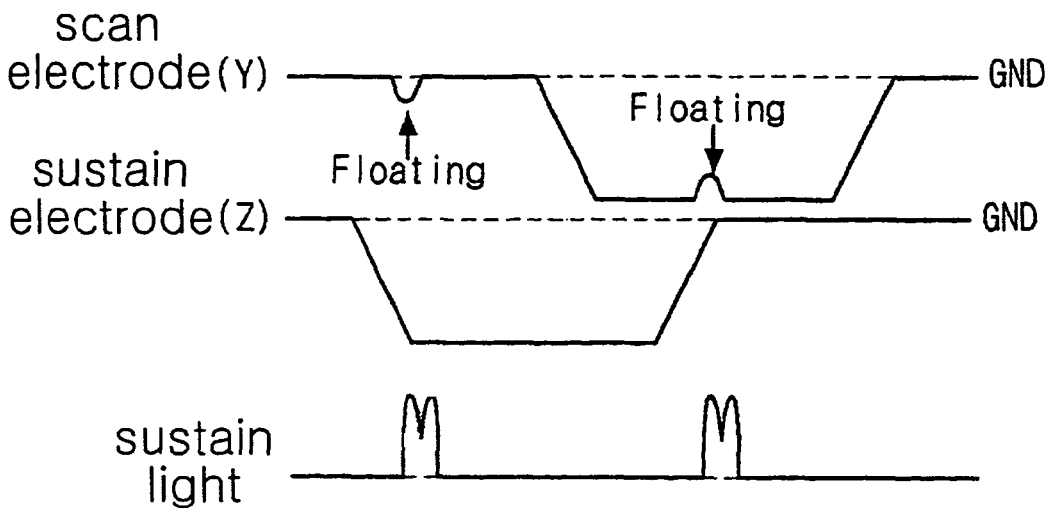

Referring FIG. 12*c*, same as FIG. 12*b*, the negative sustain pulse is alternately applied to the scan electrode Y and the sustain electrode Z. The sustain pulse applied to the scan electrode Y and the sustain pulse applied to the sustain electrode Z are overlapped each other. As shown in FIG. 12*c*, different with FIG. 12*b*, the sustain pulse applied to the scan electrode Y overlaps the latter part of the sustain pulse applied to the sustain electrode Z. Therefore, when the sustain pulse applied to the sustain electrode Z, the scan electrode Y is set to be floating in the given point. Compared with FIG. 9*c*, FIG. 12*c* is only different in that the sustain pulse descends from the ground level GND to the negative sustain voltage −Vs, but it is substantially identical with FIG. 9*c* and the overlapped description is omitted.

Figure 12D:
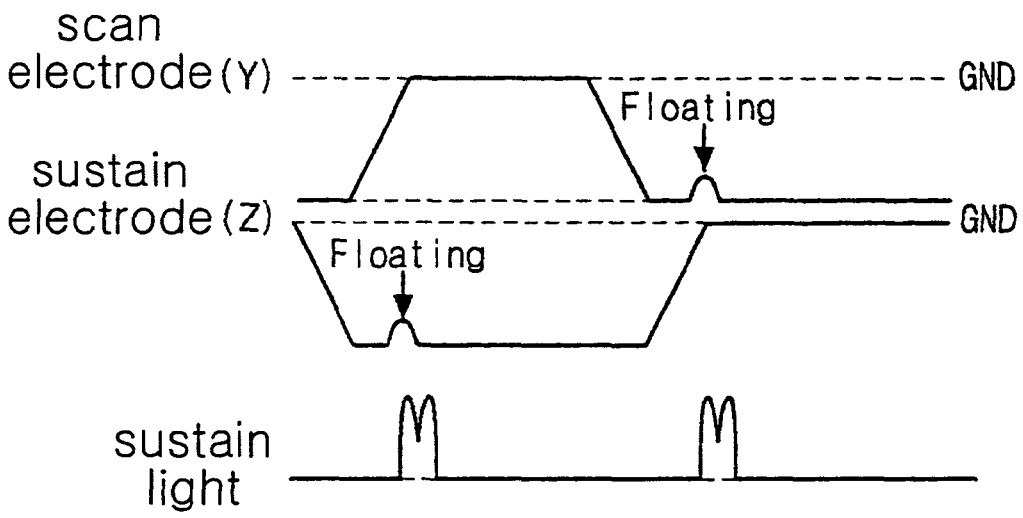
Figure 13A:
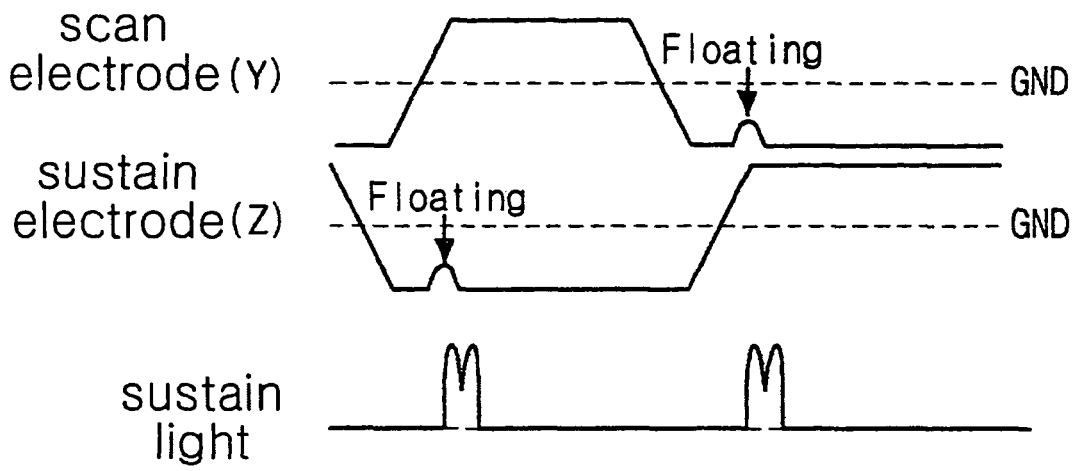
FIGS. 13*a* through 13*d* are the drawing illustrating a third preferred embodiment of the driving method of the plasma display apparatus according to the present invention.
Figure 13B:
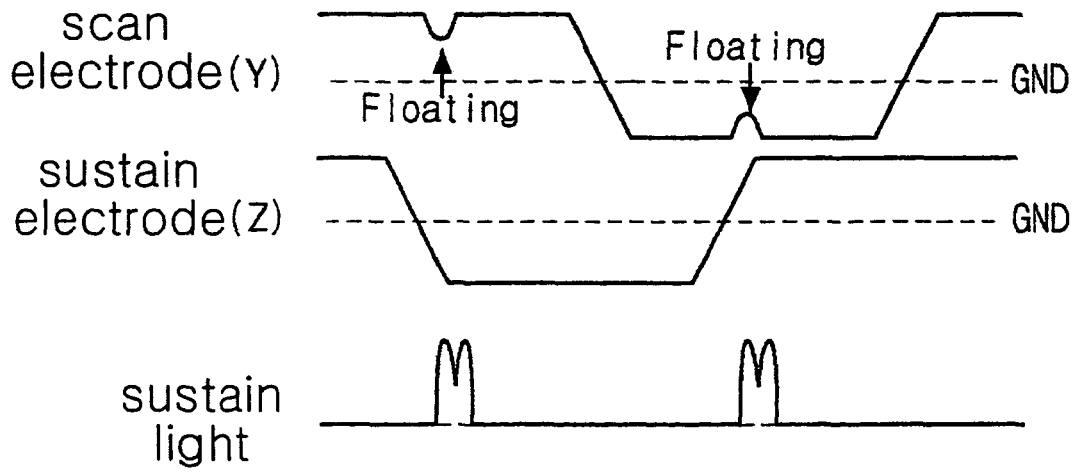
Figure 13C:
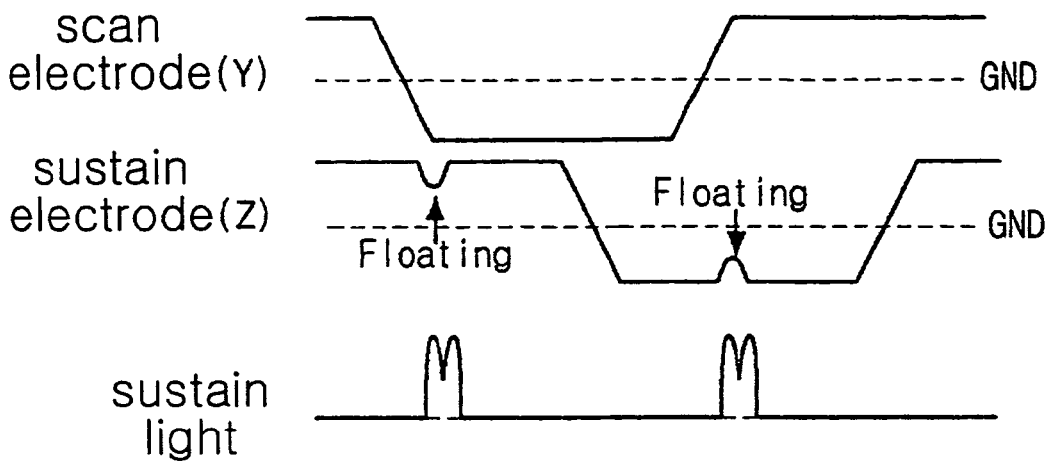
Figure 13D:
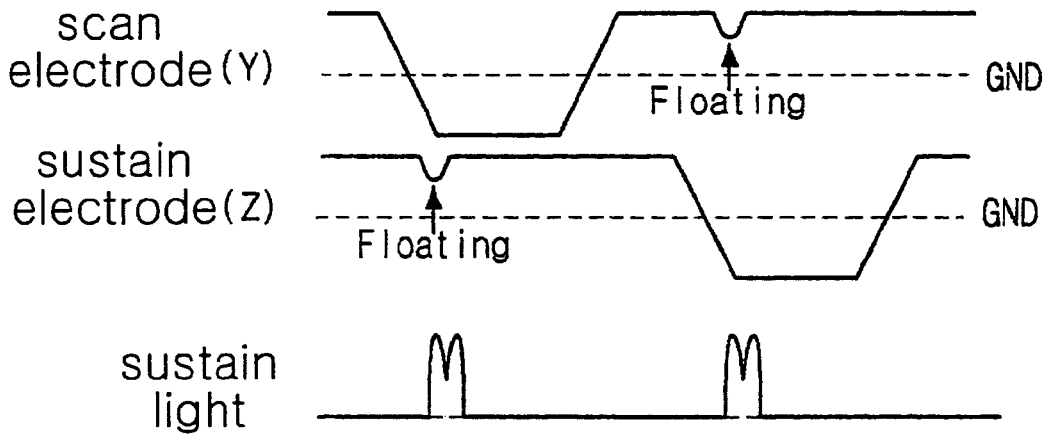

Referring FIG. 12*d*, same as FIG. 12*a*, the scan electrode Y and the sustain electrode Z is alternately set to be floating during the sustain period. As shown in FIG. 12*d*, different with FIG. 12*a*, the floating is performed by cut off the electrical connection between the sustain electrode Z maintaining a given negative voltage such as negative sustain voltage −Vs and the sustain voltage source supplying the sustain voltage Vs in a given point, when the sustain pulse applied to the scan electrode Y rises from the negative sustain voltage −Vs to the ground level GND.

When the sustain pulse applied to the sustain electrode Z, the scan electrode Y is set to be floating in the given point. It is performed in the same method as the sustain electrode Z is set to be floating in the given point, when the sustain pulse applied to the scan electrode Y rises from the negative sustain voltage −Vs to the ground level GND.

In the first preferred embodiment and the second preferred embodiment of the driving method of the plasma display apparatus according to the present invention described in the above, it showed that either the scan electrode Y or sustain electrode Z was supplied with the sustain pulse having positive polarity or the sustain pulse having negative polarity during the sustain period. However, the present invention is applicable in the mode, which is different from the above, where the sustain discharge is generated by using both the positive sustain pulse and the negative sustain pulse during the sustain period. Referring to FIGS. 13*a* through 13*d*, it will be described in detail.

FIGS. 13*a* through 13*d* are the drawing illustrating a third preferred embodiment of the driving method of the plasma display apparatus according to the present invention.

As to the FIGS. 13*a* through 13*d*, in the third preferred embodiment of the driving method of the plasma display apparatus according to the present invention, both the sustain pulse having negative polarity and sustain pulse having positive polarity are altogether used during the sustain period. In other words, the sustain pulse rising from the voltage of the negative polarity to the voltage of the positive polarity or the sustain pulse falling from the voltage of the positive polarity to the voltage of the negative polarity is supplied to either the scan electrode Y or the sustain electrode Z during the sustain period. During the sustain period where the sustain pulse is supplied, according to the average picture level APL, either the scan electrode Y or the sustain electrode Z is set to be floating during the given period.

Compared with the FIGS. 9*a* through 9*d* of the first preferred embodiment of the driving method of the plasma display apparatus described in the above, or with the FIGS. 10*a* through 10*d* of the driving method of the plasma display apparatus described in the above, the FIGS. 13*a* through 13*d* are substantially identical, so the overlapped description is omitted.

That is, in the FIGS. 13*a* through 13*d*, the sustain pulse supplied to either the scan electrode Y or the sustain electrode Z during the sustain period is a rising pulse or a falling pulse. The rising pulse is a pulse that rises from a predetermined negative voltage, for example, a half of the sustain voltage −Vs/2 having negative polarity to a predetermined positive voltage, for example, a half of the sustain voltage Vs/2 having positive polarity. The falling pulse is a pulse that falls from a predetermined positive voltage, for example, a half of the sustain voltage Vs/2 having positive polarity to a predetermined negative voltage, for example, a half of the sustain voltage −Vs/2 having negative polarity.

Figure 14A:
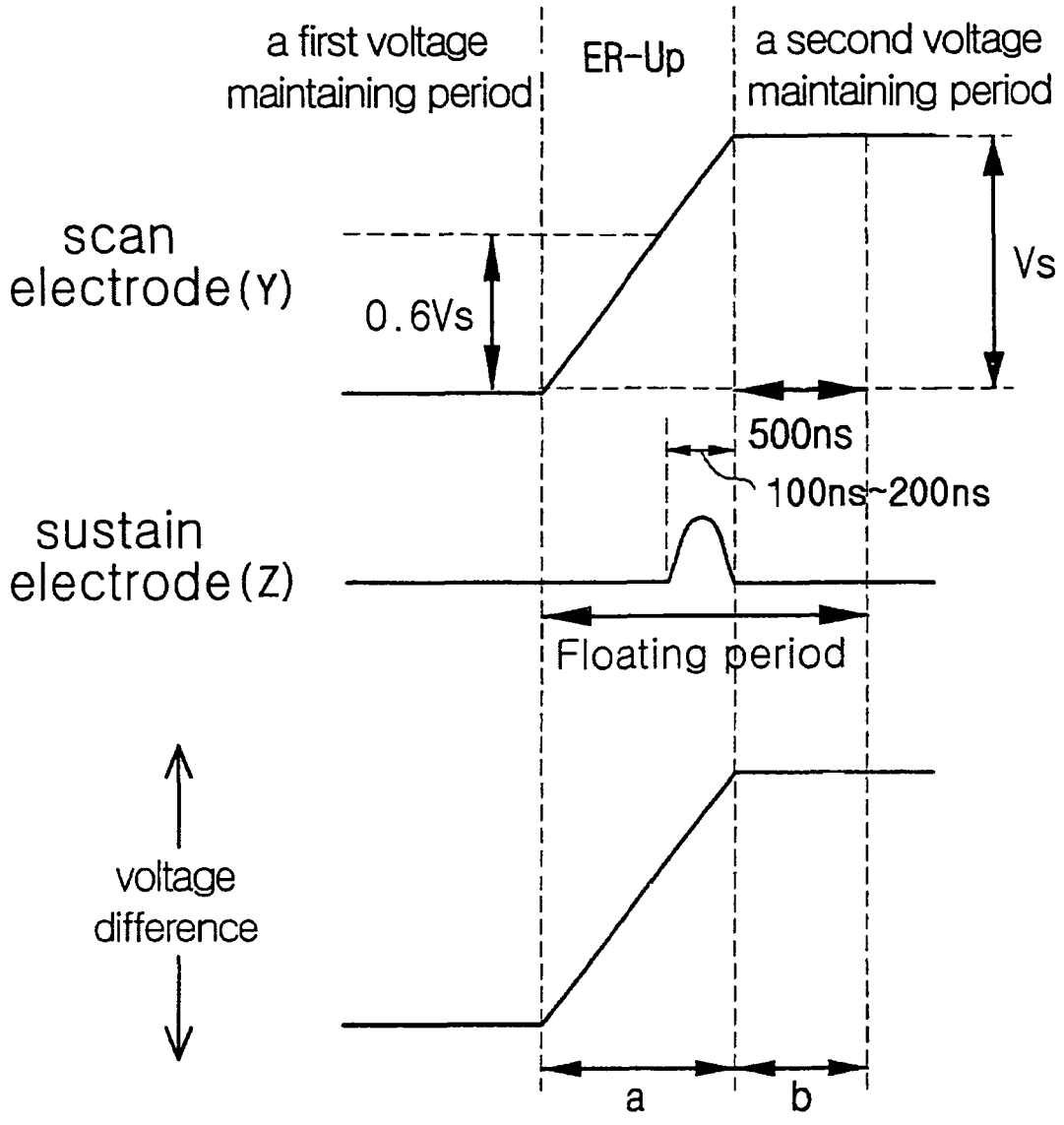
FIGS. 14*a* through 14*b* are the drawing illustrating the floating for the scan electrode Y or the sustain electrode Z during the sustain period.
Figure 14B:
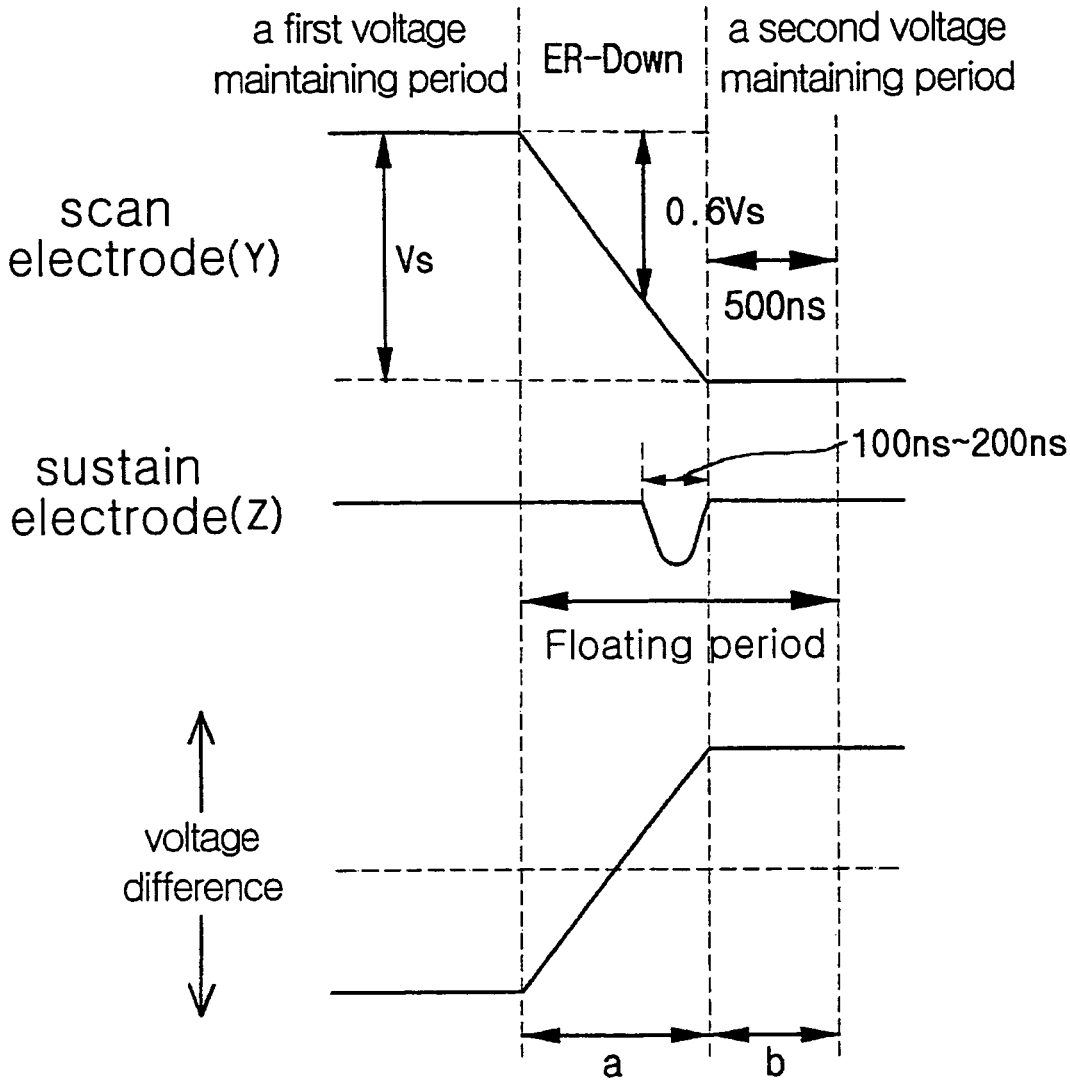

In this way, either the scan electrode Y or the sustain electrode Z is set to be floating during the sustain period in order to generate the double discharge. In FIGS. 14*a* and 14*b*, the method for setting up of the floating period is as follows:

FIGS. 14*a* through 14*b* are the drawing illustrating the floating for the scan electrode Y or the sustain electrode Z during the sustain period.

As to the FIGS. 14*a* through 14*b*, either the scan electrode Y or the sustain electrode Z is set to be floating for a given time during the sustain period, while only one electrode of the scan electrode Y or the sustain electrode Z is set to be floating for the given time. The electrode set to be floating between the scan electrode Y or the sustain electrode Z is the electrode that maintains a constant voltage.

For example, as shown in FIG. 14*a*, when the scan electrode Y is supplied with the sustain pulse rising from the ground level GND while the sustain electrode Z maintains the ground level voltage GND, only the sustain electrode Z maintaining the predetermined voltage, for example, the ground level voltage GND, is set to be floating between the scan electrode Y or the sustain electrode Z.

The given time point for floating either the scan electrode Y or the sustain electrode Z during the sustain period is set in the interval between the point of time when the voltage difference of the sustain pulse supplied to the scan electrode Y and the sustain electrode Z increases and the point of time when the voltage difference of the sustain pulse supplied to the scan electrode Y and the sustain electrode Z decreases after maintaining a constant voltage difference.

For example, as shown in FIG. 14*a*, the sustain electrode Z is set to be floating between the voltage rising period ER-Up Time (a) and a second voltage maintaining period (b). In the voltage rising period ER-Up Time (a), the voltage difference between the scan electrode Y and the sustain electrode Z increases, while the scan electrode Y is supplied with the sustain pulse rising from the ground level GND and the sustain electrode Z maintains the ground level voltage GND. In the second voltage maintaining period (b), the voltage difference between the scan electrode Y and the sustain electrode Z is uniformly maintained, while the scan electrode Y maintains the sustain voltage Vs after the sustain pulse supplied to the scan electrode Y rise from the ground level GND, the sustain electrode Z maintains the ground level voltage GND.

On the other hand, as shown in FIG. 14*b*, the sustain electrode Z is set to be floating between the voltage falling period ER-Down Time (a) and the second voltage maintaining period (b). In the voltage falling period ER-Down Time (a), the voltage difference between the scan electrode Y and the sustain electrode Z increases, while the scan electrode Y is supplied with the sustain pulse falling from the sustain voltage Vs and the sustain electrode Z maintains the sustain voltage Vs. In the second voltage maintaining period (b), the voltage difference between the scan electrode Y and the sustain electrode Z is uniformly maintained, while the scan electrode Y maintains the ground level voltage GND after the sustain pulse supplied to the scan electrode Y falls from the sustain voltage Vs and the sustain electrode Z maintains the sustain voltage Vs.

In FIG. 14*a*, when the sustain electrode Z is to be set floating, the sustain pulse supplied to the scan electrode Y rises to change the polarity of the voltage of the sustain electrode Z into the positive direction. In FIG. 14*b*, when the sustain electrode Z is to be set floating, the sustain pulse supplied to the scan electrode Y falls to change the polarity of the voltage of the sustain electrode Z into the negative direction.

It is preferable that the predetermined period for floating either the scan electrode Y or the sustain electrode Z during the sustain period is set between the time point of reaching 60% of the peak value of the sustain pulse and within 500 ns after accessing the peak value of the sustain pulse.

In this way, the predetermined period for floating either the scan electrode Y or the sustain electrode Z during the sustain period is a part of the interval between the period (b) where the voltage difference between the scan electrode Y and the sustain electrode Z begins to increase and 500 ns after the time point where the voltage difference between the scan electrode Y and the sustain electrode Z begins to maintain a constant voltage.

It is preferable that the widest period including the floating period for floating either the scan electrode Y or the sustain electrode Z during the sustain period starts from 100 ns to 1000 ns after the voltage difference between the scan electrode Y and the sustain electrode Z begins to increase.

As described above, in the embodiments of the present invention, the floating period for floating either the scan electrode Y or the sustain electrode Z during the sustain period was set as a part of the period in which the voltage difference between the scan electrode Y and the sustain electrode Z increase during the sustain period. Accordingly, in case either the scan electrode Y or the sustain electrode Z is set to be floating in the period where the voltage difference between the scan electrode Y and the sustain electrode Z increase during the sustain period, the floated electrode is operated associated with the voltage variation of the electrode, between the scan electrode Y and the sustain electrode Z, which is not floated in the floating time. In that way, the double discharge is more readily generated.

It is preferable that the length of the floating period for floating either the scan electrode Y or the sustain electrode Z during the sustain period ranges from 100 ns to 200 ns. That is, the range of the floating period is limited from 100 ns to 200 ns. For generating the double discharge, it requires that either the scan electrode Y or the sustain electrode Z is set to be floating for a time over 100 ns as a sufficient double discharge time. If either the scan electrode Y or the sustain electrode Z is set to be floating for a time which exceeds 200 ns, the sustain pulse supplied to the scan electrode Y and the sustain electrode Z may be excessively distorted, thereby making the sustain discharge unstable.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising a first electrode and a second electrode supplied with respective sustain pulses; and a controller to apply a first auxiliary discharge pulse to the second electrode during a time period when the sustain pulse applied to the first electrode rises and to apply a second auxiliary discharge pulse to the second electrode during a time period when the sustain pulse applied to the first electrode falls during a sustain period, wherein the first auxiliary discharge pulse has a positive polarity and the second auxiliary discharge pulse has a negative polarity relative to a peak voltage of the sustain pulse applied to the second electrode.

2. The apparatus of claim 1, wherein the first and second auxiliary discharge pulses are applied at a time point when there is about a maximum voltage difference between the first electrode and the second electrode.

3. The apparatus of claim 1, wherein the first and second auxiliary discharge pulses are formed by floating the second electrode.

4. The apparatus of claim 3, wherein the second electrode is floated for a duration that ranges from 100 ns to 200 ns.

5. The apparatus of claim 3, wherein floating of the second electrode is controlled based on average picture level information.

6. The apparatus of claim 5, wherein the average picture level information provides an indication of average picture level based on a number of discharge cells that are turned on.

7. The apparatus of claim 1, wherein the first and second auxiliary discharge pulses are applied in an interval between a time point when a voltage of the sustain pulse reaches substantially 60% of a maximum sustain voltage and substantially 500 ns after a time point when the voltage of the sustain pulse reaches the maximum sustain voltage.

8. The apparatus of claim 1, wherein the sustain pulses are alternately applied to the first electrode and the second electrode.

9. The apparatus of claim 1, wherein the sustain pulses applied to the first electrode and the second electrode are simultaneously applied for a predetermined time.

10. The apparatus of claim 1, wherein the second auxiliary discharge pulse is applied to the second electrode at a same time a sustain pulse is applied to the second electrode so that the second auxiliary discharge pulse and the sustain pulse applied to the second electrode overlap, and wherein a magnitude of the sustain pulse applied to the second electrode falls during a period of said overlap and rises after said period of overlap.

11. The apparatus of claim 10, wherein the first auxiliary discharge pulse is applied to the second electrode when no sustain pulse is applied to the second electrode.

12. The apparatus of claim 11, wherein the second auxiliary discharge pulse is applied to the second electrode between a leading and trailing edge of the sustain pulse applied to the second electrode.

13. The apparatus of claim 12, wherein the second electrode falls to a voltage value lower than a maximum voltage value when the second auxiliary discharge pulse is applied to the second electrode and rises back to the maximum voltage value after the auxiliary discharge pulse is applied but before the trailing edge of the sustain pulse applied to the second electrode.

14. The apparatus of claim 1, wherein a rising edge of the sustain pulse applied to the first electrode includes a negative pulse that occurs at a same time the first auxiliary discharge pulse is applied to the second electrode, and where simultaneous occurrence of the negative pulse applied to the first electrode and the first auxiliary discharge pulse applied to the second electrode generates a double discharge of light, wherein a first discharge of light has a peak smaller than a peak of a second discharge of light.

15. A plasma display apparatus comprising:

a plasma display panel comprising a first electrode and a second electrode supplied with respective sustain pulses; and a controller to generate a first auxiliary discharge pulse by floating the second electrode during a time period when the sustain pulse applied to the first electrode rises and to generate a second auxiliary discharge pulse by floating the second electrode during a time period when the sustain pulse applied to the first electrode falls during a sustain period, wherein the first auxiliary discharge pulse has a positive polarity and the second auxiliary discharge pulse has a negative polarity relative to a peak voltage of the sustain pulse applied to the second electrode.

16. The apparatus of claim 15, wherein the floating time point when the first and second auxiliary discharge pulses are generated is the time point when there is about a maximum voltage difference between the first electrode and the second electrode.

17. The apparatus of claim 15, wherein the second electrode is floated for a duration that ranges from 100 ns to 200 ns.

18. The apparatus of claim 15, wherein the first and second auxiliary discharge pulses are generated in an interval between a time point when a voltage of the sustain pulse reaches substantially 60% of a maximum sustain voltage and substantially 500 ns after a time point when the voltage of the sustain pulse reaches the maximum sustain voltage.

19. The apparatus of claim 15, wherein the sustain pulses are alternately applied to the first electrode and the second electrode.

20. The apparatus of claim 15, wherein the sustain pulses applied to the first electrode and the second electrode are simultaneously applied for a predetermined time.

21. A method of driving plasma display apparatus, the method comprising:

applying sustain pulses to a first electrode and a second electrode, during a sustain period;

floating the second electrode during a time period when the sustain pulse applied to the first electrode rises to generate a first auxiliary discharge pulse; and floating the second electrode during a time period when the sustain pulse applied to the first electrode falls to generate a second auxiliary discharge pulse, wherein the first auxiliary discharge pulse has a positive polarity and the second auxiliary discharge pulse has a negative polarity relative to a peak voltage of the sustain pulse applied to the second electrode.

22. The method of claim 21, wherein a time point of floating the second electrode is a time point when there is about a maximum voltage difference between the first electrode and the second electrode.

23. The method of claim 21, wherein the second electrode is floated for a duration that ranges from 100 ns to 200 ns.

24. The method of claim 21, wherein the second electrode is floated in an interval between a time point when a voltage of the sustain pulse reaches substantially 60% of a maximum sustain voltage and substantially 500 ns after a time point when the voltage of the sustain pulse reaches the maximum sustain voltage.

25. The method of claim 21, wherein the sustain pulses are alternately applied to the first electrode and the second electrode.

26. The method of claim 21, wherein the sustain pulses applied to the first electrode and the second electrode are simultaneously applied for a predetermined time.

* * * * *